US012410677B2

(12) United States Patent
Roselier et al.

(10) Patent No.: US 12,410,677 B2
(45) Date of Patent: Sep. 9, 2025

(54) MULTIPLE EXPANDABLE METAL PACKERS WITH HYDROLOCK PREVENTION

(71) Applicant: Schlumberger Technology Corporation, Sugar Land, TX (US)

(72) Inventors: Samuel Roselier, Bruz (FR); Romain Neveu, Bruz (FR); Robin Laupie, Bruz (FR); Nicolas Saltel, Rio de Janeiro (BR); Dinesh Patel, Humble, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/720,970

(22) PCT Filed: Jan. 23, 2023

(86) PCT No.: PCT/US2023/011307
§ 371 (c)(1),
(2) Date: Jun. 17, 2024

(87) PCT Pub. No.: WO2023/141311
PCT Pub. Date: Jul. 27, 2023

(65) Prior Publication Data

US 2025/0075588 A1 Mar. 6, 2025

Related U.S. Application Data

(60) Provisional application No. 63/302,222, filed on Jan. 24, 2022.

(51) Int. Cl.
*E21B 33/122* (2006.01)
*E21B 34/06* (2006.01)

(52) U.S. Cl.
CPC ..... *E21B 33/122* (2013.01); *E21B 34/06* (2013.01)

(58) Field of Classification Search
CPC ..... E21B 33/1243; E21B 33/127; E21B 33/1272; E21B 33/1275
See application file for complete search history.

(56) References Cited

U.S. PATENT DOCUMENTS 3,456,725 A * 7/1969 Hatch ..... E21B 33/14 166/147
3,948,145 A * 4/1976 Garaty ..... E21B 19/086 91/519

(Continued)

FOREIGN PATENT DOCUMENTS

EP 3159478 A1 4/2017
EP 3628813 A1 4/2020

(Continued)

OTHER PUBLICATIONS

Search Report and Written Opinion of International Patent Application No. PCT/US2023/011307 dated May 11, 2023, 8 pages.

*Primary Examiner* — David Carroll
(74) *Attorney, Agent, or Firm* — Jeffrey D. Frantz

(57) ABSTRACT

A technique facilitates improved actuation and use of packers disposed along a well string and placed in a borehole, e.g. a wellbore. A plurality of packers may be disposed along a base pipe, e.g. a production tubing. Each packer has an expandable sleeve which may be expanded into a fully expanded configuration establishing a secure, sealing engagement with a surrounding wall. e.g. a surrounding wellbore wall. Additionally, a hydrolock prevention valve system comprises a valve which may be actuated to allow or block the flow of fluid from an annular region or regions between the packers.

11 Claims, 8 Drawing Sheets

(56) References Cited

U.S. PATENT DOCUMENTS

| | | | | |
|---|---|---|---|---|
| 5,549,165 | A * | 8/1996 | Brooks | E21B 33/1243 166/185 |
| 6,047,239 | A * | 4/2000 | Berger | E21B 49/08 702/9 |
| 9,217,308 | B2 | 12/2015 | Wood | |
| 10,190,386 | B2 | 1/2019 | Stæhr | |
| 10,947,810 | B2 | 3/2021 | Vasques | |
| 11,091,975 | B2 | 8/2021 | Roselier | |
| 11,142,987 | B2 | 10/2021 | Vasques | |
| 2002/0100585 | A1* | 8/2002 | Spiers | E21B 49/0813 166/264 |
| 2006/0248949 | A1 | 11/2006 | Gregory | |
| 2009/0183882 | A1* | 7/2009 | van Zuilekom | E21B 49/081 166/371 |
| 2014/0190708 | A1 | 7/2014 | Hallundbæk | |
| 2021/0071495 | A1* | 3/2021 | Vasques | E21B 33/1208 |

FOREIGN PATENT DOCUMENTS

| | | | |
|---|---|---|---|
| EP | 3601718 | B1 | 6/2021 |
| WO | 2020152262 | A1 | 7/2020 |

* cited by examiner

MULTIPLE EXPANDABLE METAL PACKERS WITH HYDROLOCK PREVENTION

CROSS-REFERENCE TO RELATED APPLICATIONS

This application is a national stage entry under 35 U.S.C. 371 of International Application No. PCT/US2023/011307, entitled "Multiple Expandable Metal Packers with Hydrolock Prevention," filed Jan. 23, 2023, which claims the benefit of U.S. Provisional Application No. 63/302,222, entitled "Multiple Expandable Metal Packers with Hydrolock Prevention," filed Jan. 24, 2022, the disclosure of which is incorporated herein by reference in its entirety.

BACKGROUND

In many oil and gas well applications, a wellbore is drilled into the earth and through a reservoir of a desired fluid, e.g. oil and/or gas. The wellbore may subsequently be completed with appropriate completion equipment having packers which may be expanded to isolate regions along the wellbore. For example, packers may be disposed along sand control equipment or other types of completion equipment to facilitate production of the desired fluids from the reservoir. Depending on the application, the packers may be mounted along a well string and selectively expanded to effectively form a seal between base pipe of the well string and the surrounding wellbore wall. In some applications, multiple packers are expanded simultaneously and fluid becomes trapped between the packers. As expansion of the packers continues, the trapped fluid can prevent the packers from expanding properly to their fully expanded configuration.

SUMMARY

In general, a system and methodology facilitate improved actuation and use of packers disposed along a well string and placed in a borehole, e.g. a wellbore. A plurality of packers may be disposed along a base pipe, e.g. a production tubing. Each packer has an expandable sleeve which may be expanded into a fully expanded configuration which establishes a secure, sealing engagement with a surrounding wall, e.g. a surrounding wellbore wall. Additionally, a hydrolock prevention valve system comprises a valve which may be actuated to allow or block the flow of fluid from an annular region or regions between the packers.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology which facilitate improved actuation and use of multiple packers disposed in a wellbore or other type of borehole. According to an embodiment, a well system comprises a plurality of packers disposed along a base pipe, e.g. a production tubing, of an overall well string. In some embodiments, the plurality of packers may comprise two packers which may be arranged as straddle packers or other types of cooperating pairs of packers. However, other embodiments may comprise three or more packers arranged along the well string.

According to an embodiment of the well system, each packer may have an expandable sleeve which may be expanded into a fully expanded configuration which establishes a secure, sealing engagement with a surrounding wall, e.g. a surrounding wellbore wall. By way of example, the expandable sleeve may be an expandable metal sleeve of an expandable metal packer. In an expandable metal packer, the expandable sleeve may be in the form of a metal bladder which is selectively deformed downhole by, for example, hydroforming.

Additionally, the well system may comprise a hydrolock prevention valve system having a valve which may be actuated to allow or block the flow of fluid from an annular region or regions between the packers. For example, the valve may be set to allow flow from the annular region(s) between the packers to an annular region outside of the packers, e.g. an annular region uphole or downhole of the packers. The valve may then be selectively actuated to a closed position when, for example, the packers are fully set in their fully expanded configuration. In some embodiments, the actuation of the valve to the closed position may be automatically triggered when a predetermined pressure is reached within the expanded packers.

Figure 1:
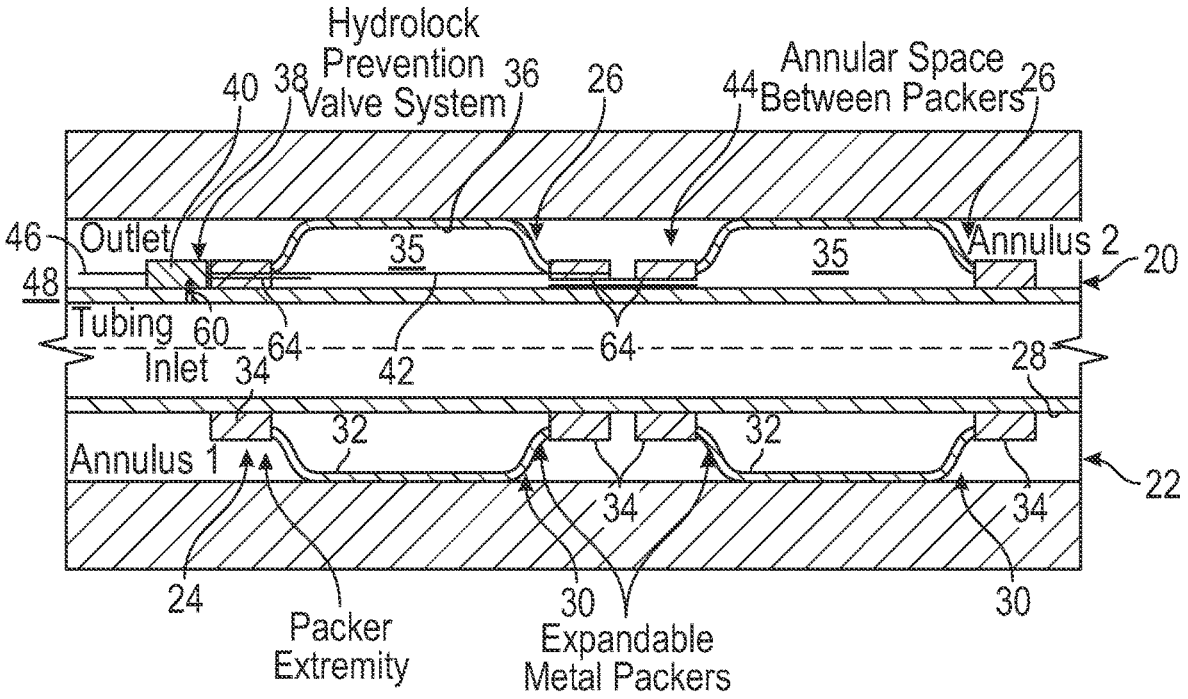
FIG. 1 is an illustration of an example of a well system having multiple packers positioned along a well string deployed in a borehole, e.g. a wellbore, in combination with a hydrolock prevention valve system according to an embodiment of the disclosure.

Referring generally to FIG. 1, an example of a well string 20 is illustrated as positioned within a borehole 22, e.g. a wellbore, and comprising a well system 24. In this embodiment, the well string 20 comprises multiple packers 26 disposed along a base pipe 28. FIG. 1 illustrates the multiple packers 26 as comprising two packers 26 although three or more packers 26 may be used in other embodiments.

Each packer 26 may be in the form of an expandable packer with an expandable sleeve 30. By way of example, each packer 26 may be an expandable metal packer in which the expandable sleeve 30 is in the form of an expandable metal sleeve which may be constructed as a metal bladder 32. The metal sleeve/bladder 32 may be expanded and deformed downhole under fluid pressure, e.g. by hydroforming. In some embodiments, each expandable sleeve 30 is secured to base pipe 28 by pipe connectors 34 which may be in the form of packer extremities connected to the longitudinal extremity of each expandable sleeve 30. When fluid under sufficient pressure is directed into a packer cavity 35 between the pipe connectors 34 of each packer 26 and between the corresponding expandable sleeve 30 and base pipe 28, the expandable sleeve 30 is deformed in a radially outward direction. If sufficient pressure is continually applied, the expandable sleeve 30 deforms into secure, sealing engagement with a surrounding wall 36, e.g. a surrounding wellbore wall, as illustrated in FIG. 1.

As illustrated, the well string 20 also comprises a hydrolock prevention valve system 38 which has a valve 40, a first flow passage 42 extending to an annular space 44 located between packers 26, and a second flow passage 46 extending to an annular section 48 outside of the packers 26. In other words, the second flow passage 46 may extend to annular section 48 located uphole or downhole of the plurality of packers 26. The valve 40 is selectively actuatable to allow or block flow between the first flow passage 42 and the second flow passage 46.

Figure 2:
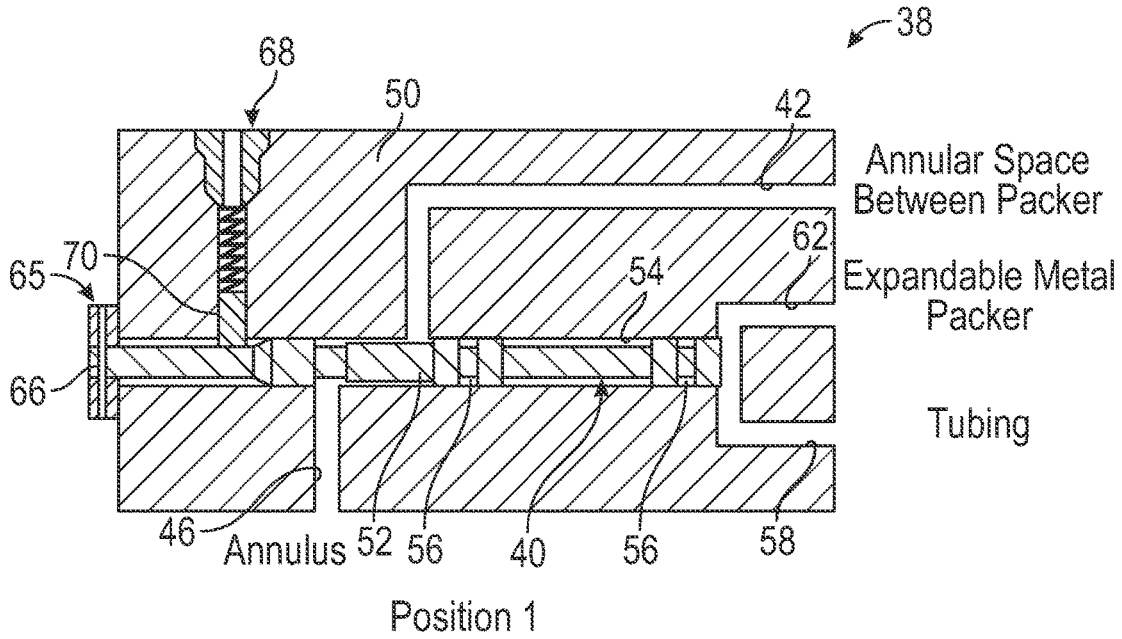
FIG. 2 is a cross-sectional illustration of an example of a hydrolock prevention valve system, according to an embodiment of the disclosure.
Figure 3:
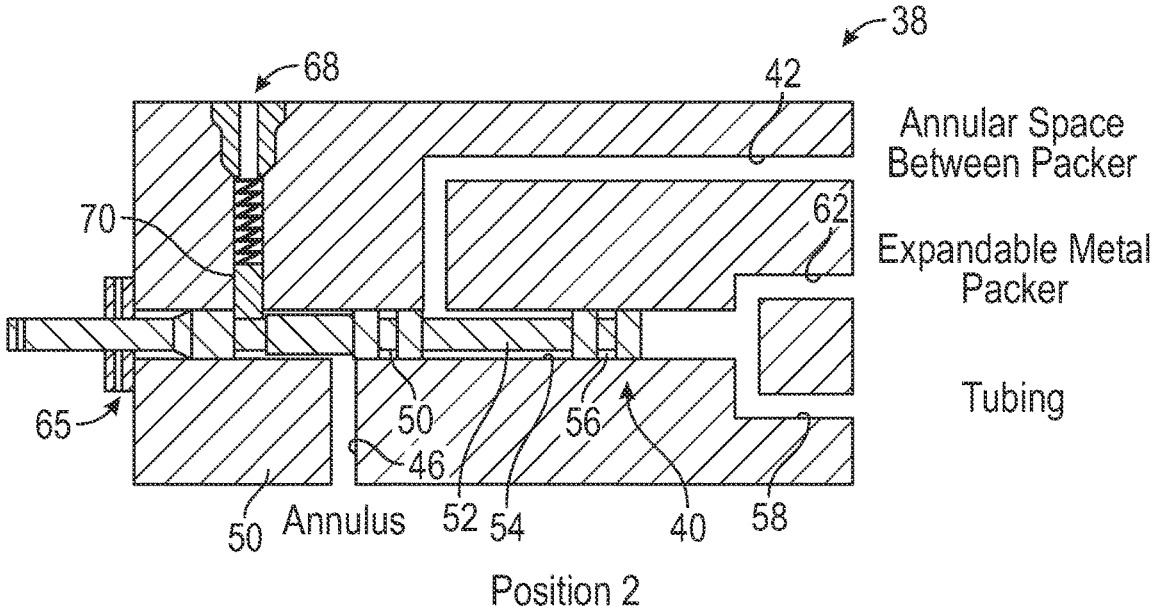
FIG. 3 is a cross-sectional illustration of the hydrolock prevention valve system shown in FIG. 2 but in a different operational position, according to an embodiment of the disclosure.

Referring generally to FIGS. 2 and 3, one embodiment of hydrolock prevention valve system 38 is illustrated. In this embodiment, valve 40 is slidably positioned in a valve housing 50 between first flow passage 42 and second flow passage 46. The valve 40 may comprise an elongated piston 52 slidably mounted in a corresponding piston passage 54 of valve housing 50. Furthermore, the elongated piston 52 may have seals 56 which form a sealing engagement between elongated piston 52 and the surrounding wall forming piston passage 54. The seals 56 are arranged to enable selective flow of fluid between first flow passage 42 and second flow passage 46 via connection through passage 54 or to block flow of fluid therethrough (depending on the position of piston 52).

In this example, the valve housing 50 also comprises a tubing passage 58 in fluid communication with piston passage 54 and with the interior of base pipe 28 via one or more expansion ports 60 extending laterally through the wall of base pipe 28 (see FIG. 1). The valve housing 50 also may comprise a packer passage 62 in fluid communication with piston passage 54 and with the packer cavities 35. The packer passage 62 may be placed in fluid communication with packer cavities 35 via ports/passages 64 formed through at least some of the pipe connectors/extremities 34 (see FIG. 1).

In FIG. 2, the valve 40 is illustrated in the open position allowing flow of fluid between the first flow passage 42 and the second flow passage 46. The valve 40 may be placed in this configuration when, for example, the well string 20 is run-in-hole and during setting of packers 26. In this valve configuration, the interior of the base pipe 28 is in fluid communication with the packer cavities 35 via tubing passage 58 and packer passage 62 to allow expansion of the expandable sleeves 30 when fluid under sufficient pressure is directed down through the interior of base pipe 28. In this valve position, the annular space 44 between packers 26 also is connected to the annulus externally of packers 26, i.e. to annular section 48.

As a result, liquid in the annular space 44 is able to bleed out through first flow passage 42, piston passage 54, and second flow passage 46 to the annular section 48. Because the liquid is able to bleed from annular space 44, the potential for hydrolock inside this annular space 44 during expansion of packers 26 is reduced or eliminated. In other words, hydrolock is not able to prevent the packers 26 from fully expanding.

Once the packers 26 are fully set via expansion to their fully expanded configuration, the valve 40 may be actuated to the closed position blocking flow between first flow passage 42 and second flow passage 46, as illustrated in FIG. 3. In this flow blocking position, piston 52 has been shifted so that seals 56 prevent fluid flow between first and second flow passages 42, 46. In some embodiments, the piston 52 is initially held in the position allowing flow by a securing element 65, such as a shear element 66 which ruptures at a preset pressure level. The shear element 66 may be constructed so the preset pressure level is high enough to allow full expansion of the packers 26 while the piston 52 is exposed to the expansion pressure via passages 58, 62. However, once the pressure rises above the preset pressure level, the shear element 66 is sheared and the piston 52 is shifted to the flow blocking position illustrated in FIG. 3. In some embodiments, the piston 52 may be held in this flow blocking position by a mechanical device 68, such as a spring-loaded retention member 70.

Figure 4:
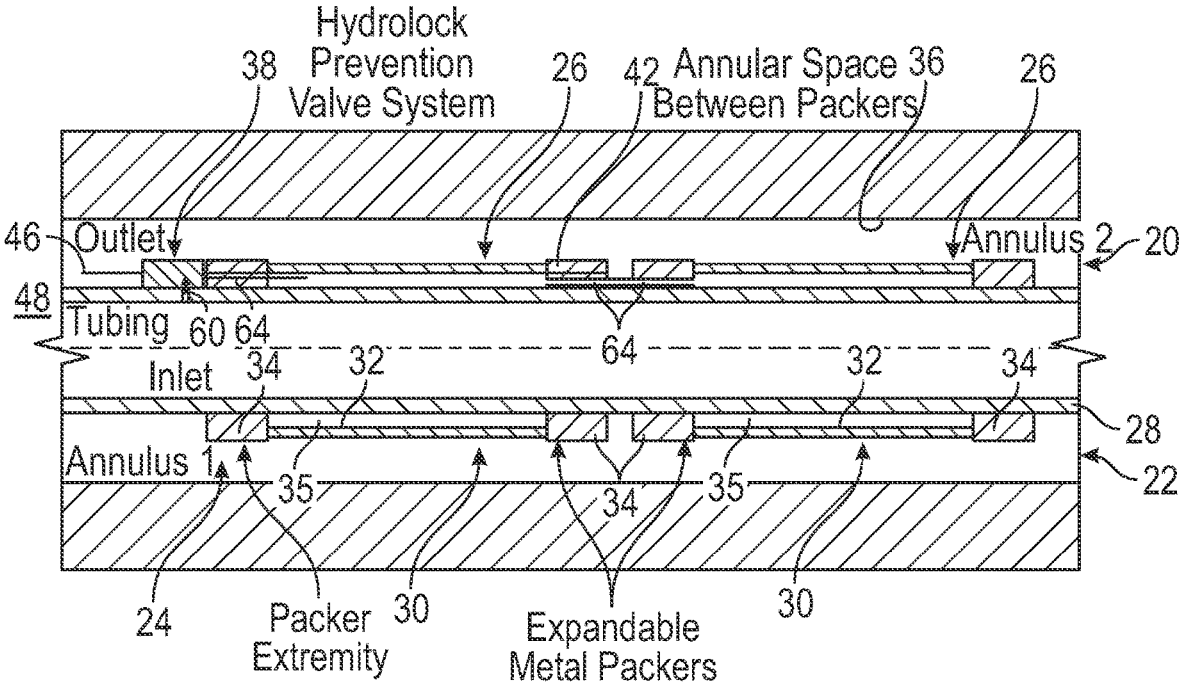
FIG. 4 is an illustration of an example of a well system having multiple packers and a hydrolock prevention valve system deployed in a run-in-hole configuration, according to an embodiment of the disclosure.
Figure 5:
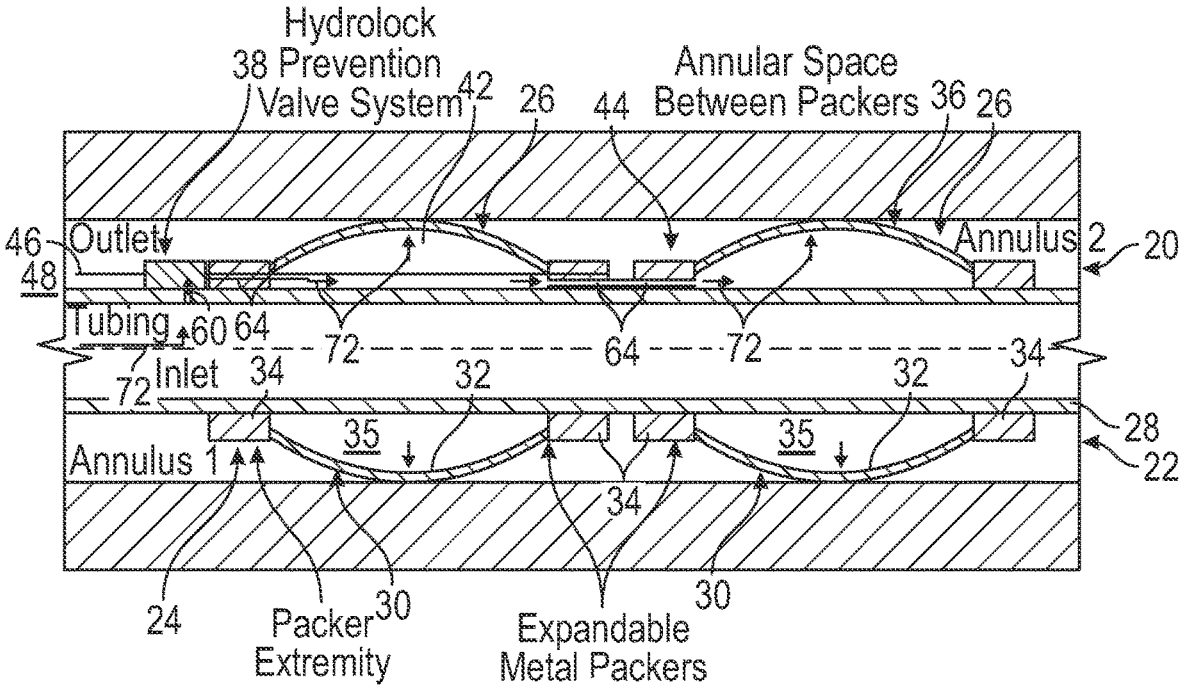
FIG. 5 is an illustration of an example of a well system having multiple packers and a hydrolock prevention valve system deployed downhole in another configuration, according to an embodiment of the disclosure.

In operation, the well string 20 and well system 24 are initially deployed down into borehole 22 with packers 26 in a contracted or unexpanded configuration, as illustrated in FIG. 4. Once the packers 26 are at a desired location in borehole 22, fluid under pressure may be directed down through the interior of base pipe 28, through lateral port 60, through pipe connector ports 64, and into cavities 35 to initiate expansion of expandable packer sleeves 30, as illustrated in FIG. 5 by arrows 72.

Figure 6:
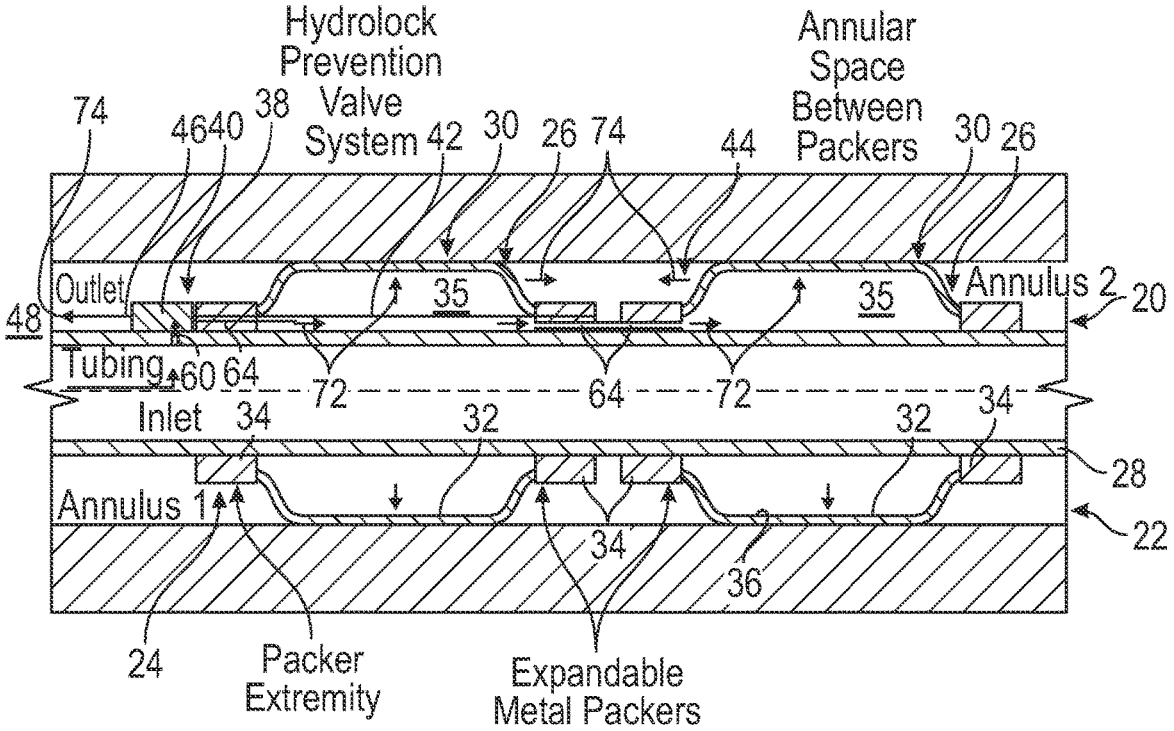
FIG. 6 is an illustration of an example of a well system having multiple packers and a hydrolock prevention valve system deployed downhole in another configuration, according to an embodiment of the disclosure.

Initially, the sleeves 30 are expanded into first contact with the surrounding borehole wall 36. In some embodiments, the sleeves 30 may be metal sleeves comprising metal bladders 32 with a sealing element along the outer surface to facilitate creation of a seal with the surrounding wall 36. Once the seal is initiated, the confined annular space 44 is established. As expansion of the packers 26 is continued to the fully expanded configuration illustrated in FIG. 6, the annular space 44 is further constrained.

Figure 7:
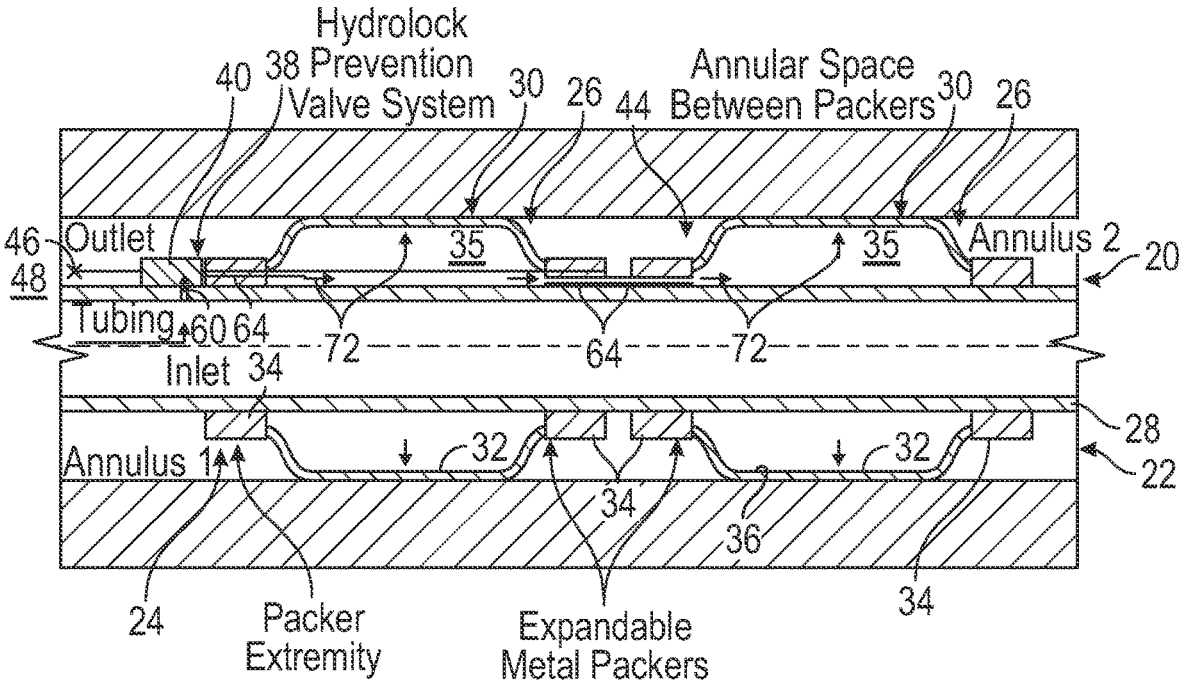
FIG. 7 is an illustration of an example of a well system having multiple packers and a hydrolock prevention valve system deployed downhole in another configuration, according to an embodiment of the disclosure.

However, as annular space 44 decreases in size excess fluid within the confined annular space 44 is able to escape via hydrolock prevention valve system 38 by flowing through first flow passage 44, valve 40, and second flow passage 46 to annular section 48, as represented by arrows 74. It should be noted the first flow passage 44 may be established via passages extending through the appropriate pipe connectors 34 and packer cavity(ies) 35 as illustrated. After the packers 26 have been deformed/expanded to their fully expanded configuration and excess fluid/pressure has been bled from annular space 44, the valve 40 may be transitioned to the flow blocking position as illustrated in FIG. 7. Actuating valve 40 to the closed or flow blocking position may be achieved via increasing the pressure within packers 26 above a predetermined level to cause shifting of piston 52 as described above.

Figure 8:
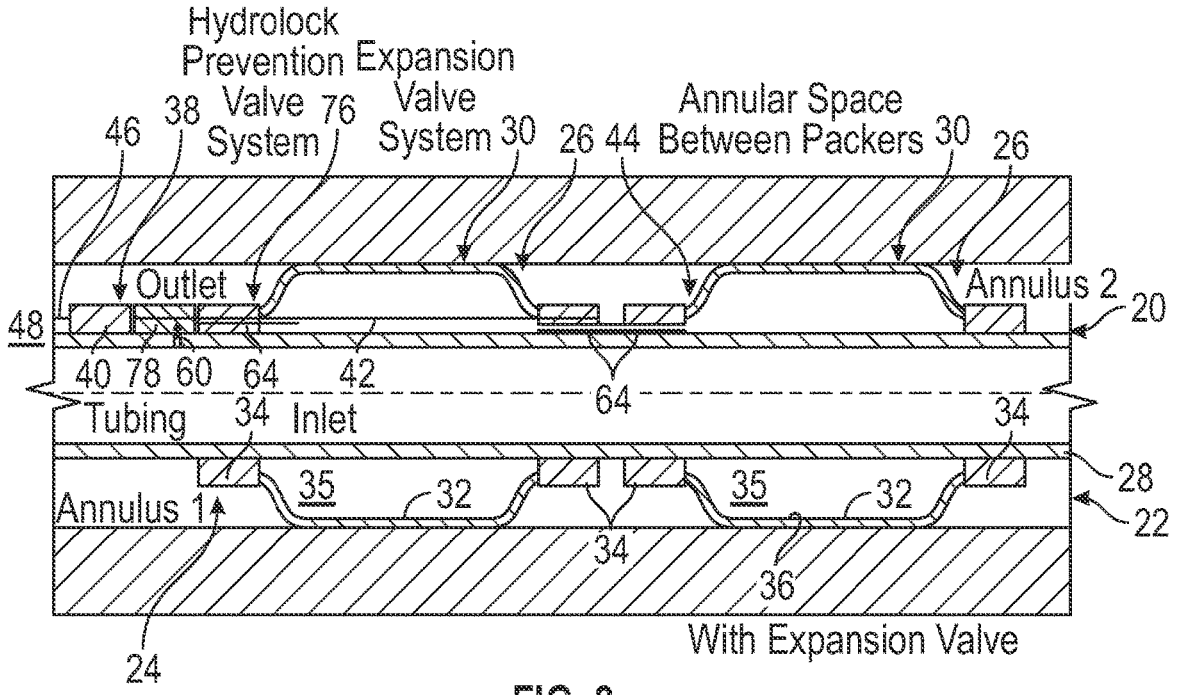
FIG. 8 is an illustration of an example of a well system having multiple packers and a hydrolock prevention valve system combined with an expansion valve system, according to an embodiment of the disclosure.

Referring generally to FIG. 8, another embodiment of well system 24 is illustrated. In this example, an expansion valve system 76 is used in cooperation with the hydrolock prevention valve system 38. The expansion valve system 76 comprises an expansion valve 78 which allows communication between the interior of base pipe 28 and the expandable packers 26 during expansion of the packers 26. However, the expansion valve 78 closes off the lateral expansion port 60 at a preset pressure. The expansion valve system 76 and the hydrolock prevention valve system 38 may be combined in the same valve housing or they may use separate valve housings. Depending on the application, the two valve systems 38, 76 may utilize a common piston 52 or separate pistons.

Figure 9:
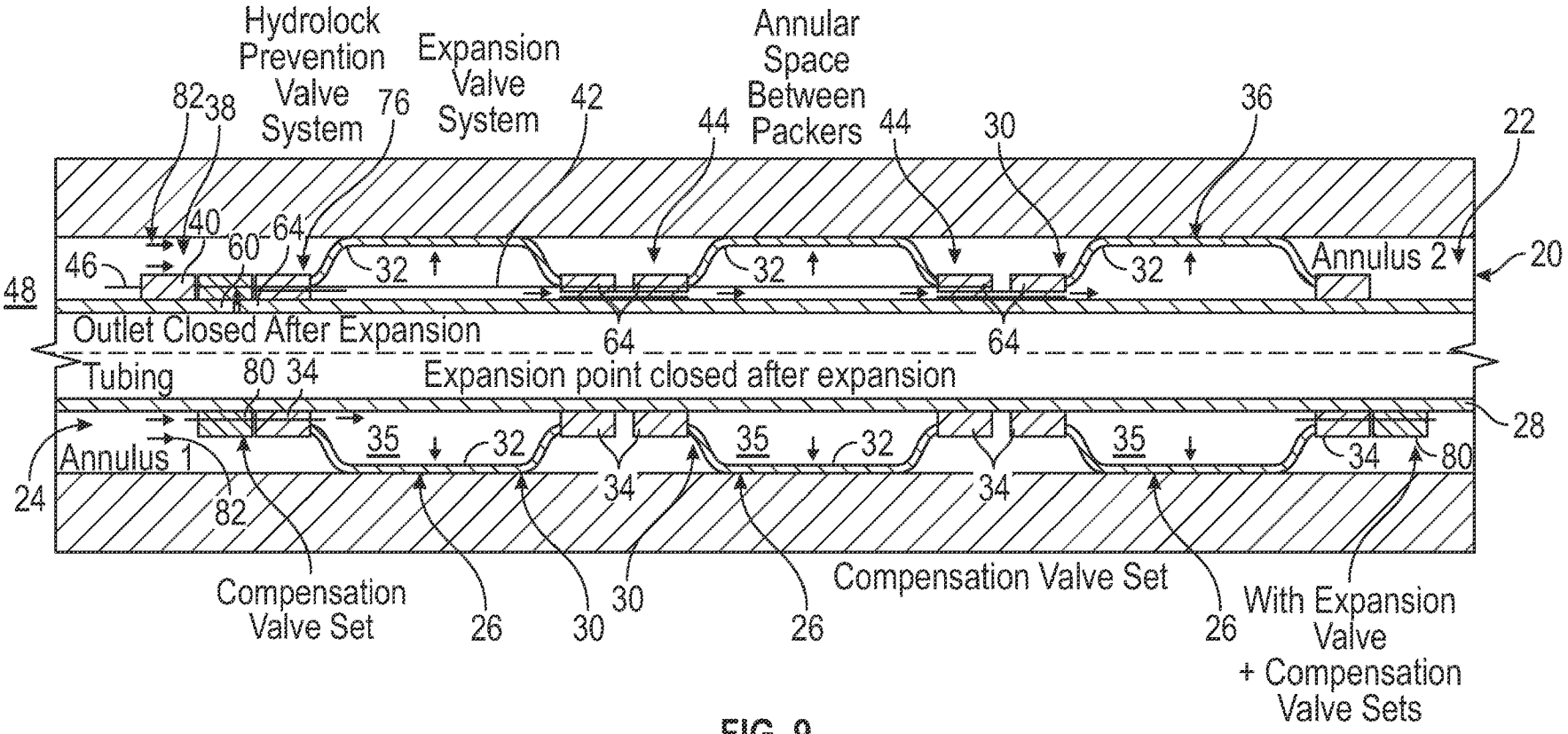
FIG. 9 is an illustration of an example of a well system having multiple packers and a hydrolock prevention valve system combined with both an expansion valve system and a compensation valve system, according to an embodiment of the disclosure.
Figure 10:
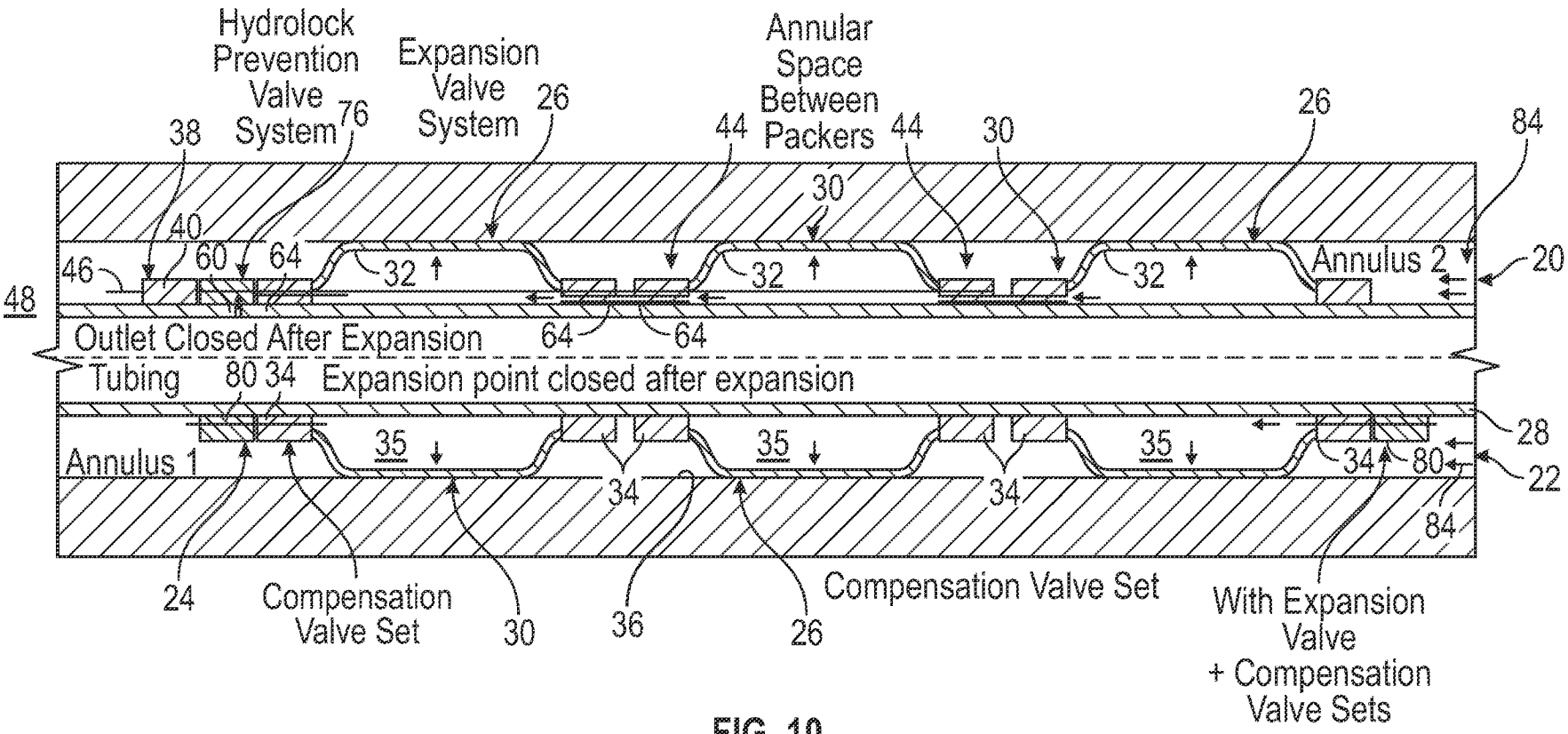
FIG. 10 is another illustration of an example of a well system having multiple packers and a hydrolock prevention valve system combined with both an expansion valve system and a compensation valve system, according to an embodiment of the disclosure.

As illustrated in FIG. 9, the hydrolock prevention valve system 38 also may be combined with a compensation valve system 80 or with both the expansion valve system 76 and the compensation valve system 80. The compensation valve system 80 is used for annulus pressure compensation when the packers 26 are set. For example, the well system 24 may utilize two compensation valve systems 80 with one system 80 placed on each end of the plurality of packers 26. This enables annulus pressure compensation with respect to an uphole annulus section (as represented by arrows 82 in FIG. 9) and/or with respect to a downhole annulus section (as represented by arrows 84 in FIG. 10). In this latter embodiment, three packers 26 are illustrated although other numbers of packers 26, e.g. greater numbers of packers 26, also may be utilized in a given well system 24.

Figure 11:
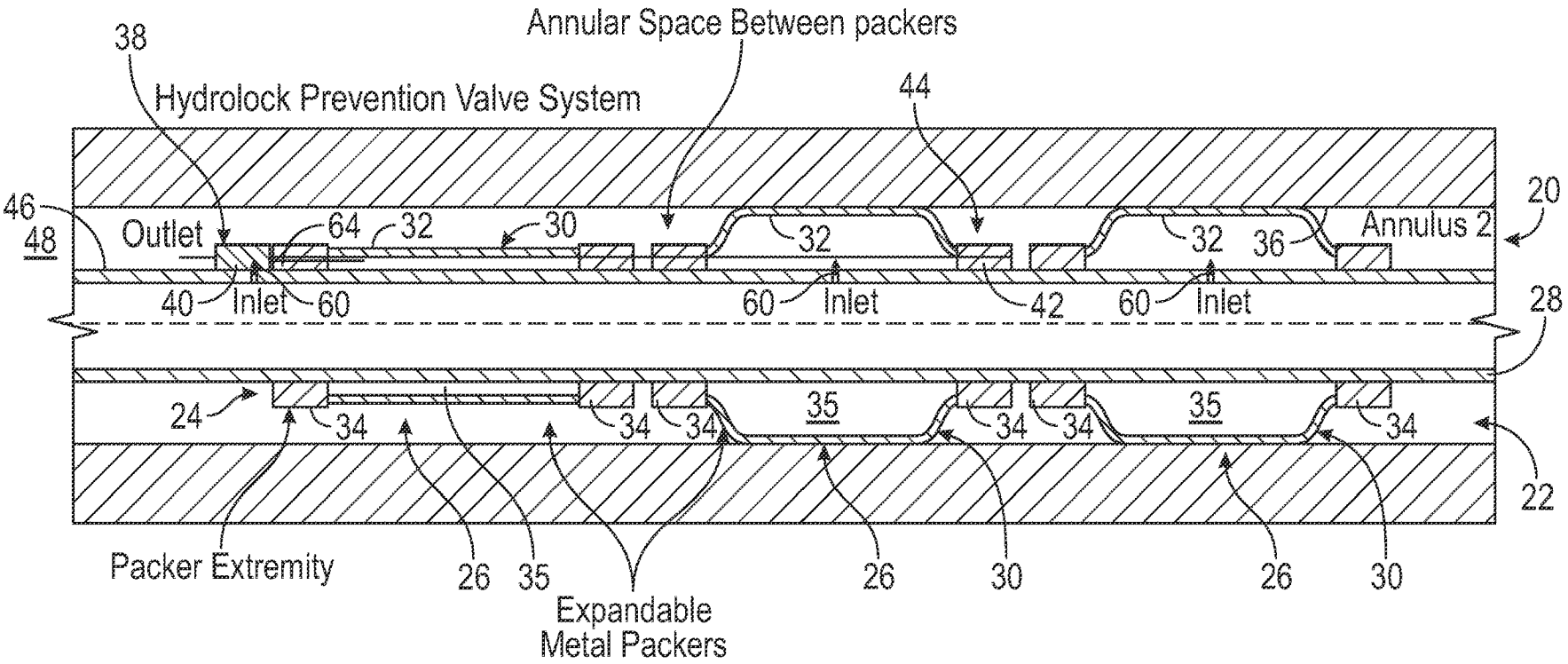
FIG. 11 is an illustration of another example of a well system having multiple packers and a hydrolock prevention valve system which may be utilized with individually expandable packers, according to an embodiment of the disclosure.
Figure 12:
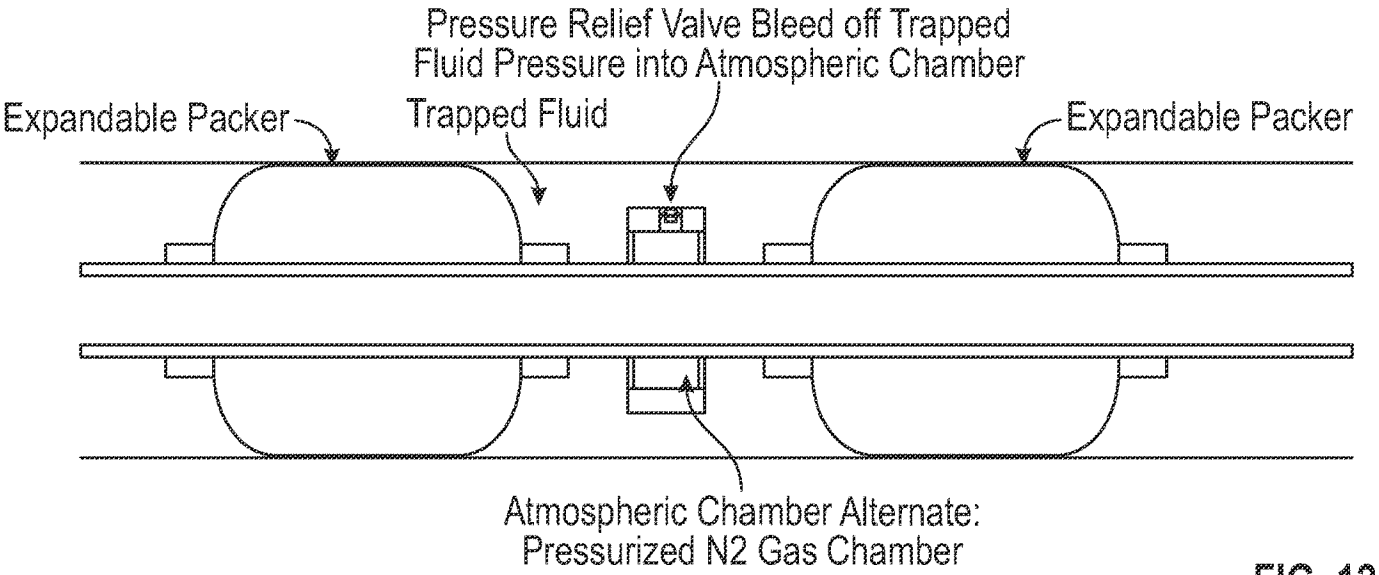
FIG. 12 is an illustration of another example of a well system having multiple packers and a hydrolock prevention valve system which may be utilized with individually expandable packers, according to an embodiment of the disclosure.
Figure 13:
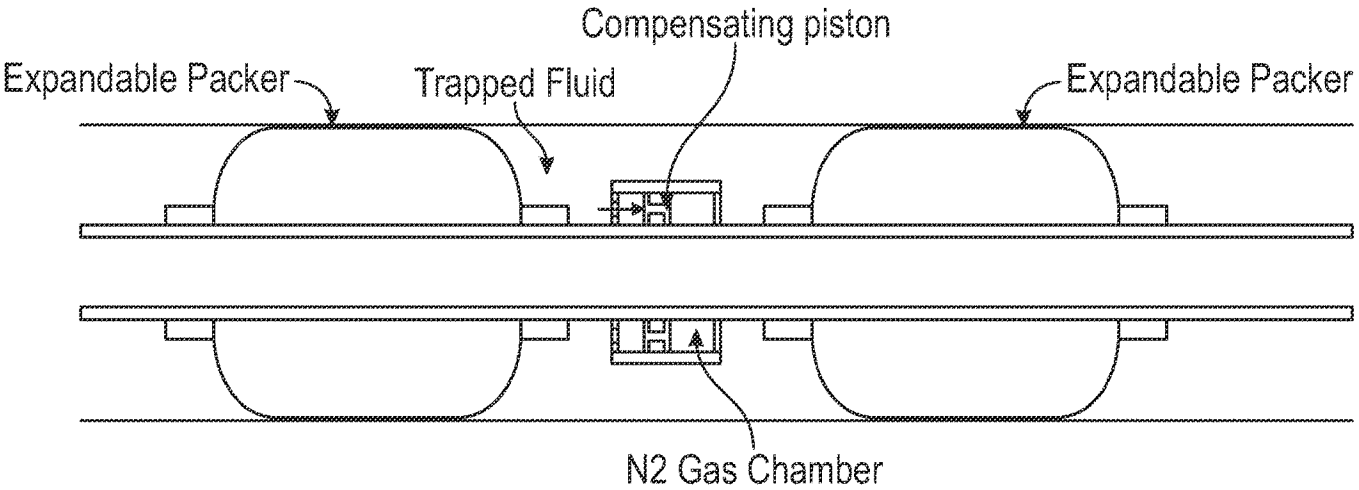
FIG. 13 is an illustration of another example of a well system having multiple packers and a hydrolock prevention valve system which may be utilized with individually expandable packers, according to an embodiment of the disclosure.

In embodiments described above, the packers 26 are expanded to their fully expanded/set configuration simultaneously. However some embodiments may be constructed so the packers 26 can be set independently, as illustrated in FIG. 11. As illustrated, two of the packers 26 have been expanded while one of the packers 26 has not yet been expanded. The independent and individual expansion of packers 26 may be achieved via a variety of tools, such as a straddle cup tool which allows pressure to be applied in a specified zone for inflation and expansion of specified corresponding packers 26.

Depending on the parameters of a given operation and the environment in which such operation is conducted, the well system 24 may comprise a variety of components and configurations. For example, the packers 26 and expandable sleeves 30 may be made in a variety of sizes, configurations, and materials. Similarly, the valve systems 38, 76, 84 may be constructed in various cooperating combinations and with various pistons, flow passage architectures, seals, and/or other components and features to accommodate the desired actuations. Similarly, the packers 26 and overall construction of well system 24 may be selected for use in open hole boreholes, cased boreholes, or within other types of downhole tubing.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a well string size for deployment in a wellbore, the well string comprising:

a base pipe;

a plurality of packers disposed along the base pipe, each packer having an expandable metal sleeve which may be expanded into a fully expanded configuration forming a secure, sealing engagement with a surrounding wall;

an annular space between packers of the plurality of packers; and a hydrolock prevention valve system having a valve, a flow passage within a valve body between the annular space and an annular section outside of the plurality of packers, the valve being actuatable such that a piston of the valve allows flow between the annular space and the annular section outside of the plurality of packers in a first position and blocks flow between the annular space and the annular section outside of the plurality of the packers in a second position, wherein the piston includes a tapered outer surface and a groove, wherein the valve body includes a spring-loaded retention member. and wherein in response to the piston moving to the second position, the spring-loaded retention member moves along the tapered outer surface and into the groove, thereby retaining the piston in the second position.

2. The system as recited in claim 1, wherein the valve is configured to allow flow between the annular space and the annular section outside of the plurality of the packers while the well string is run into the wellbore.

3. The system as recited in claim 1, wherein the valve is configured to allow flow between the annular space and the annular section outside of the plurality of the packers during expansion of the plurality of packers into the fully expanded configuration so as to enable evacuation of excess fluid from the annular space between packers.

4. The system as recited in claim 1, wherein the valve is configured to block flow between the annular space and the annular section outside of the plurality of the packers after expansion of the plurality of packers to the fully expanded configuration.

5. The system as recited in claim 1, wherein the plurality of packers comprises two packers.

6. The system as recited in claim 1, wherein the plurality of packers comprises at least three packers.

7. The system as recited in claim 1, further comprising an expansion valve configured to work in cooperation with the hydrolock prevention valve system.

8. The system as recited in claim 1, further comprising a compensation valve configured to work in cooperation with the hydrolock prevention valve system.

9. The system as recited in claim 7, further comprising a compensation valve configured to work in cooperation with the hydrolock prevention valve system.

10. The system as recited in claim 1, wherein the packers of the plurality of packers are configured to be expanded simultaneously.

11. The system as recited in claim 1, wherein selected packers of the plurality of packers are configured to be expanded individually.

* * * * *